US007915826B2

(12) United States Patent
Würsching et al.

(10) Patent No.: US 7,915,826 B2
(45) Date of Patent: Mar. 29, 2011

(54) ELECTRIC LAMP WITH INNER ASSEMBLY AND OUTER BULB AND METHOD FOR MANUFACTURING

(75) Inventors: István Würsching, Budapest (HU); József Fülöp, Budapest (HU); Ferenc Papp, Budapest (HU); László Bánkuti, Budapest (HU); János Orbán, Veresegyház (HU)

(73) Assignee: General Electric Company, Schenectady, NY (US)

( * ) Notice: Subject to any disclaimer, the term of this patent is extended or adjusted under 35 U.S.C. 154(b) by 503 days.

(21) Appl. No.: 12/181,419

(22) Filed: Jul. 29, 2008

(65) Prior Publication Data

US 2010/0026182 A1 Feb. 4, 2010

(51) Int. Cl.
*H01J 9/00* (2006.01)
*H01J 17/00* (2006.01)

(52) U.S. Cl. ..... 313/634; 313/567; 313/605; 313/623; 445/27

(58) Field of Classification Search ..... None
See application file for complete search history.

(56) References Cited

U.S. PATENT DOCUMENTS 6,064,155 A 5/2000 Maya et al.
7,710,039 B2 * 5/2010 Wursching et al. ..... 313/634
2007/0063656 A1 3/2007 Wursching et al.

FOREIGN PATENT DOCUMENTS

EP 1 916 699 A2 4/2008

OTHER PUBLICATIONS

PCT/US2009/049202 International SearchReport, mailed Feb. 9, 2010.
WO Written Opinion issued in connection with corresponding WO Patent Application No. US09/049202 filed on Jun. 30, 2009.

* cited by examiner

*Primary Examiner* — Nimeshkumar D Patel
*Assistant Examiner* — Natalie K Walford
(74) *Attorney, Agent, or Firm* — Fay Sharpe LLP

(57) ABSTRACT

An electric lamp comprises an inner assembly including a light source and a control gear circuit. An outer envelope encloses the light source and at least a part of the control gear and has a predetermined wall thickness and an end portion. The outer envelope is comprised of two parts separated along a circumferential line. The two parts of the envelope are connectable and sealable to form a uniform outer envelope with a seal region. The seal region has a wall thickness and is merged in a surface portion of the two parts of the envelope so that the surface unevenness of the seal region is not greater than 0.5 millimeters, and the maximum difference of the wall thickness of the seal region with respect to the wall thickness of the outer envelope is not greater than 0.3 millimeters.

A method for manufacturing an electric lamp as described above is also disclosed. During connecting, and sealing the two parts of the envelope by a welding process, the two parts are brought into a contacting position and compressed further by a first axial distance; and then the two parts are pulled apart from each other by a second axial distance in order to merge the seal region in a surface portion of the two parts, wherein the second axial distance is larger than the first axial distance.

14 Claims, 7 Drawing Sheets

ELECTRIC LAMP WITH INNER ASSEMBLY AND OUTER BULB AND METHOD FOR MANUFACTURING

FIELD OF THE INVENTION

Cross-reference is made to commonly-owned, co-pending application Ser. No. 12/181,406, filed simultaneously herewith, entitled "FIXING MECHANISM FOR AN INNER ASSEMBLY TO OUTER BULB" and to commonly-owned, co-pending application Ser. No. 12/181,414, filed simultaneously herewith, entitled "HOLDER FOR INTEGRAL COMPACT FLUORESCENT LAMP WITH OUTER BULB".

This invention relates to electric lamps, and more particularly to electric lamps with an inner assembly including a light source and a control gear circuit that can replace conventional incandescent lamps of general purpose. Even more specifically the invention relates to electric lamps that have an outer envelope also enclosing the control gear circuit.

BACKGROUND OF THE INVENTION

The majority of the known and commercially available low-pressure fluorescent discharge lamps are so-called compact fluorescent lamps (CFL-s) at present. These lamps are intended to replace incandescent lamps used in a wide field of industry and home applications. Main advantages of these lamps are a low-power consumption and a long lifetime. Disadvantageous is however in CFL-s their relatively high price and large length dimension. Many configurations have been proposed to solve the length dimension problem. Such solutions include the multiple tube arrangements and the coiled tube arrangements.

U.S. Pat. No. 6,064,155 discloses a fluorescent lamp with an outer envelope having an external shape of an incandescent lamp on a standard Edison-type base. The discharge tube is wound in a coil around the longitudinal axis of the lamp and is disposed within the outer envelope. Ballast is also disposed within the outer envelope. In order to place the discharge tube within the outer envelope, the envelope is cut midway at a seam and then resealed after placement of the discharge tube. It is not disclosed and therefore it is not clear from this document how the envelope is cut and resealed so as to form a uniform bulb shape. In case of a glass envelope, the two separated parts have to be welded which causes a thickened circumferential seam area that has a negative impact on the optical characteristics and aesthetic appearance of the lamp. In addition to this, the increased wall thickness in the seal region leads to excessive stresses in the glass wall of the envelope.

Accordingly, there is a need for an electric lamp, in particular a compact fluorescent lamp, with an outer envelope, preferably of a glass material with an improved wall construction in the seam area of the outer envelope that allows the lamp to be manufactured without substantial increase of costs. There is also need for an improved method of production, which is easy to combine with the conventional manufacturing steps and therefore compatible with mass production. It is sought to provide a compact fluorescent lamp configuration, which readily supports different types of discharge tube configurations.

SUMMARY OF THE INVENTION

In an exemplary embodiment of the present invention, there is provided an electric lamp comprising an inner assembly including a light source and a control gear circuit for controlling current in the light source and being connected to the electrodes of the light source. An outer envelope encloses the light source and at least a part of the control gear circuit and has a predetermined wall thickness and an end portion. The end portion of the outer envelope has a neck portion with an open end for receiving a base shell. The outer envelope defines a principal axis and is comprised of two parts separated along a circumferential line in a plane substantially perpendicular to the principal axis of the envelope. The two parts of the envelope are connectable and sealable to form a uniform outer envelope with a seal region. The seal region has a wall thickness and is merged in a surface portion of the two parts of the envelope so that the surface unevenness of the seal region is not greater than 0.5 millimeters; and the maximum difference of the wall thickness of the seal region with respect to the wall thickness of the outer envelope is not greater than 0.3 millimeters.

In an exemplary embodiment of another aspect of the present invention, a method for manufacturing an electric lamp is proposed. The method comprises the following steps:

a) an outer envelope is provided that has a principal axis and comprises an end portion with a neck portion, which is terminated by an open end for receiving a base shell;

b) the envelope is separated by cutting along a circumferential line in a plane substantially perpendicular to the principal axis of the envelope into a first part and a second part, each having an edge region;

c) an inner assembly including a light source and a control gear circuit is provided;

d) the inner assembly is introduced into the second part of the envelope;

e) the separated first part and second part of the envelope are brought in proximity of each other along the separation line;

f) the edge region of the first part and second part of the envelope are heated to the softening point;

g) the first and second part of the envelope is connected and sealed along the separation line.

The connecting and sealing step comprises further steps of h) bringing the two parts into a contacting position and compressing the two parts further by a first axial distance while maintaining the heating;

i) pulling the two parts apart from each other by a second axial distance in order to merge the seal region in a surface portion of the two parts, wherein the second axial distance is larger than the first axial distance.

The disclosed electric lamps provide for better optical characteristics and a nicer aesthetic appearance over prior art lamps. A simple method of production has been accomplished. There is no need for a special production line and the costs of production can be kept at a low level and the conditions for mass production are preserved. It has been found that by pulling the two parts of the envelope apart from each other not only the wall thickening will be reduced in the seal region but also the residual stresses will be significantly decreased. Further advantage of this lamp is the full mechanical and electric compatibility with bulb-shaped incandescent lamps that makes it an efficient replacement lamp. The proposed lamps provide a certain level of protection against environmental load due to the outer envelope.

BRIEF DESCRIPTION OF THE DRAWINGS

The invention will now be described in detail with reference to the enclosed drawing, in which.

DETAILED DESCRIPTION OF THE INVENTION

Figure 1:
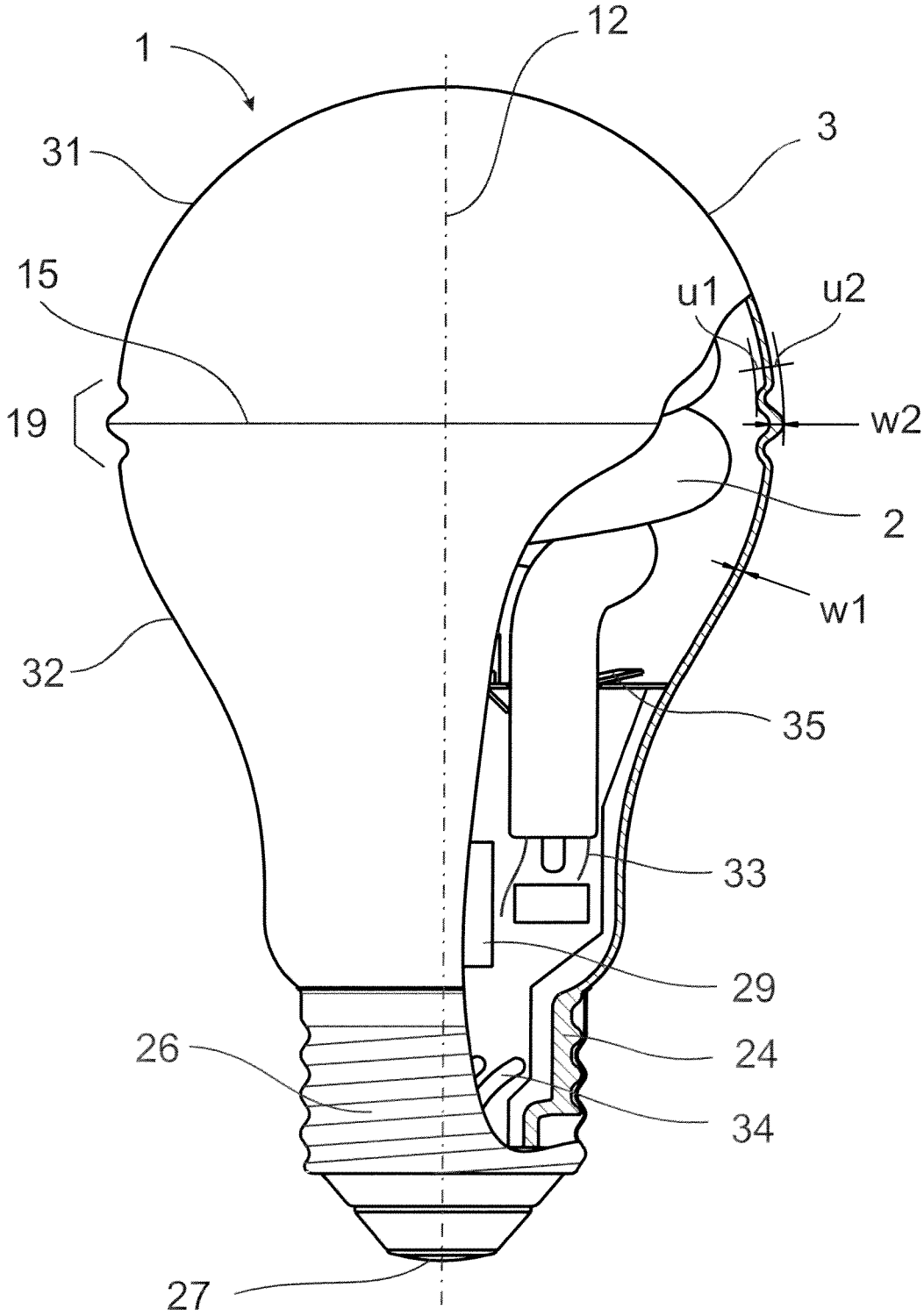
FIG. 1 is a side view of an electric lamp with an inner assembly enclosed in a two-part outer envelope connected and sealed with a prior art method, partly in cross section.
Figure 2:
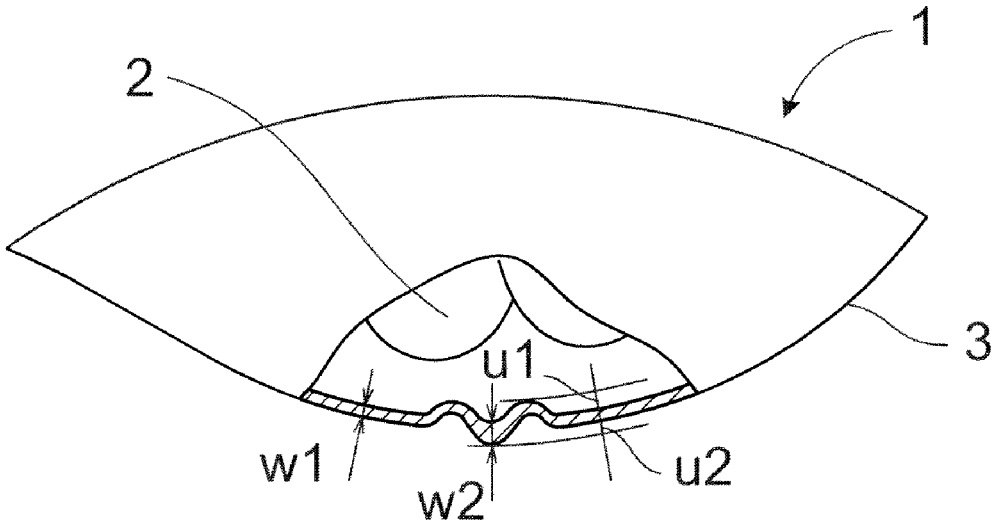
FIG. 2 is a partial cross sectional view of an electric lamp with a two-part outer envelope connected and sealed with a prior art method.

Referring first to FIGS. 1 and 2, an electric lamp 1 is shown that comprises a light source 2, a control gear circuit 29 connected to the light source 2 for controlling current in the light source and an outer envelope 3 with a predetermined, substantially uniform wall thickness w1. A standard size outer envelope with an outer diameter in the range of 50-100 millimeters has a substantially uniform wall thickness of about 0.4 millimeters to 1.0 millimeter. The outer envelope encloses the light source 2 and at least a part of the control gear circuit 29 and has an end portion with a neck portion comprising an open end for receiving a base shell 26. The neck portion may have a threaded outer wall 24 as shown for receiving a threaded base shell 26. The light source may be a discharge tube, and a ballast circuit may serve as a control gear. The discharge tube has electrodes connected to the ballast circuit by current lead in wires 33 that are led through the sealed ends of the discharge tube. The ballast circuit 29 and the discharge tube are mechanically fixed to each other by a holding and protecting shield 35. The details of the holding and protecting shield are described in co-pending U.S. patent application Ser. No. 11/837,858 filed on Aug. 13, 2007, which is hereby incorporated in its entirety by reference. The ballast circuit is connected to contact terminals of the base shell through lead out wires 34. The outer envelope 3 defines a principal axis 12 and comprises two parts separated along a circumferential line 15 in a plane substantially perpendicular to the principal axis 12 of the envelope 3 in order to accommodate the light source 2 and control gear circuit 29. The two parts 31 and 32 of the envelope are connected and sealed in order to form a uniform outer envelope with a seal region 19. The seal region 19 has a width of about 3 to 6 millimeters. In case of a glass material of the envelope, the two parts 31 and 32 may be connected by welding, which results in a seal region 19 having a wall thickness w2 which is at least 50% greater than the wall thickness w1 of the envelope outside the seal region ($w2 \geqq 1.5*w1$). As it can be clearly seen in FIGS. 1 and 2, the seal region comprises a central rib protruding from the original surface of the envelope and two rims with an intrusion into the inside of the envelope at both sides of the rib. This rib and rim structure can also be regarded as a surface unevenness that is designated by the reference signs u1 and u2. The surface unevenness can also be defined as a distance of the highest point of the rib or the lowest point of the rim from the original or ideal surface of the envelope measured in a perpendicular direction to the original surface of the envelope. The surface unevenness is in the order of the wall thickness w2 of the rib section, which is at least 50% greater than the wall thickness of the envelope outside the seal region ($u1 \approx u2 \approx w2$). Due to the increased wall thickness and the surface unevenness, increased residual stresses are present in the seal region, which can lead to breaking of the envelope in case of any mechanical or thermal shock. Such a seal region does not have an aesthetically pleasing appearance and also the optical performance is impaired.

Figure 3:
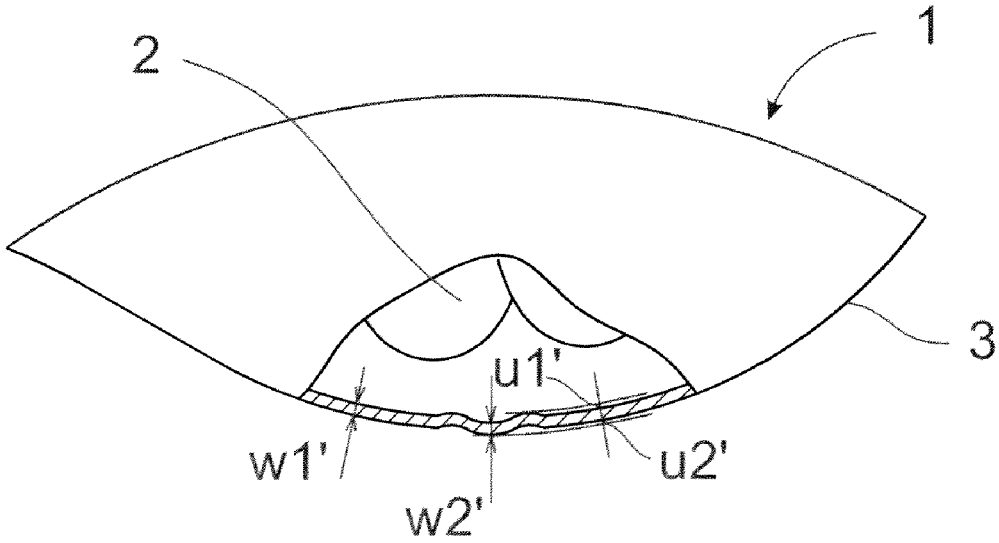
FIG. 3 is a partial cross sectional view of an electric lamp with a two-part outer envelope connected and sealed with a method of the invention.

Therefore an improved electric lamp configuration is proposed as shown in FIG. 3. In the improved configuration, similarly to the example discussed above, the lamp comprises two parts in order to accommodate a light source 2 and a control gear circuit. The two parts of the envelope are connected and sealed in order to form a uniform outer envelope with a seal region. In this lamp configuration, the envelope has a wall thickness w2' in the seal region which is merged in a surface portion of the two parts of the envelope. The surface unevenness u1', u2' of the seal region in this case is not greater than 0.5 millimeters. At the same time, the maximum difference of the wall thickness w2' in the seal region with respect to the wall thickness w1' of the outer envelope outside the seal region is not greater than 0.3 millimeters. The electric lamp may also be a fluorescent discharge lamp, wherein the light source is a discharge tube arrangement 23 and the control gear circuit is a ballast circuit. The outer envelope 3 in the shown example is a bulb shaped envelope with a spherical part and an elongated part with an open-ended neck portion, which is connected to a base shell (FIG. 1). The lamp base is configured to be adapted to a socket, which may be of any conventional or standard type normally used for lamps. The lamp base may be configured to fit in a screw type socket or a bayonet socket. In the embodiment shown in FIG. 1, the base shell connected to the neck portion is a screw type or Edison type base shell, which has a form closure with the outer wall of the neck portion. For this purpose the neck portion has a threaded outer wall 24. This threaded outer wall is not necessary if a bayonet type base shell is used. In this case the connection is established and secured by an adhesive.

In an embodiment (FIG. 5), the discharge tube arrangement 23 may be comprised of substantially straight tube members with a longitudinal axis substantially parallel with the principal axis of the fluorescent lamp. This configuration of the discharge tube arrangement 23 may comprise two or more individual, elongated, substantially parallel, straight discharge tube members of substantially same length, which are interconnected by a bridge to form a continuous arc path. The number of the individual discharge tube members will determine the output luminous intensity. The discharge tube arrangement may also comprise one or more individual, elongated discharge tube members bent in a U-shape of substantially the same length, which are interconnected by a bridge to form a continuous arc path. The number of the individual discharge tube members will be proportional to the output luminous intensity. The end sections of the discharge tube arrangement are provided with electrodes and are sealed in a gas tight manner. The electrodes are electrically connected to lead in wires 33 which are lead through the sealed end sections. The lead in wires 33 are connected to a ballast circuit 29 which comprises lead out wires 34 in order to be connected to contact terminals on a base shell.

In another embodiment (FIG. 6), the discharge tube arrangement 20 may be comprised of a single tube with substantially straight end sections and an intermediate portion between the end sections. The end sections are at one end of the tube arrangement and in proximity of each other and the intermediate portion has a coiled configuration wound about the longitudinal axis of the lamp to provide a substantially homogeneous illumination. The overall length of the discharge tube or similarly the number of windings in the coiled intermediate portion will be proportional to the output luminosity of the lamp. The diameter of the windings is selected as large as possible in order to fill and fit into the outer envelope. The end sections of the discharge tube arrangement are provided with electrodes and are sealed in a gas tight manner. The electrodes are electrically connected to lead in wires 33 which are lead through the sealed end sections. The lead in wires 33 are connected to a ballast circuit 29 which comprises lead out wires 34 in order to be connected to contact terminals on a base shell.

Referring now to FIGS. 4 to 11, the manufacturing steps for producing an electric lamp with a bulb shaped outer envelope having a substantially spherical portion and an elongated end portion will be described in detail. The electric lamp is a compact fluorescent lamp in this exemplary embodiment of the method for manufacturing. In the different figures, the same parts are provided with the same reference numerals.

Figure 4:
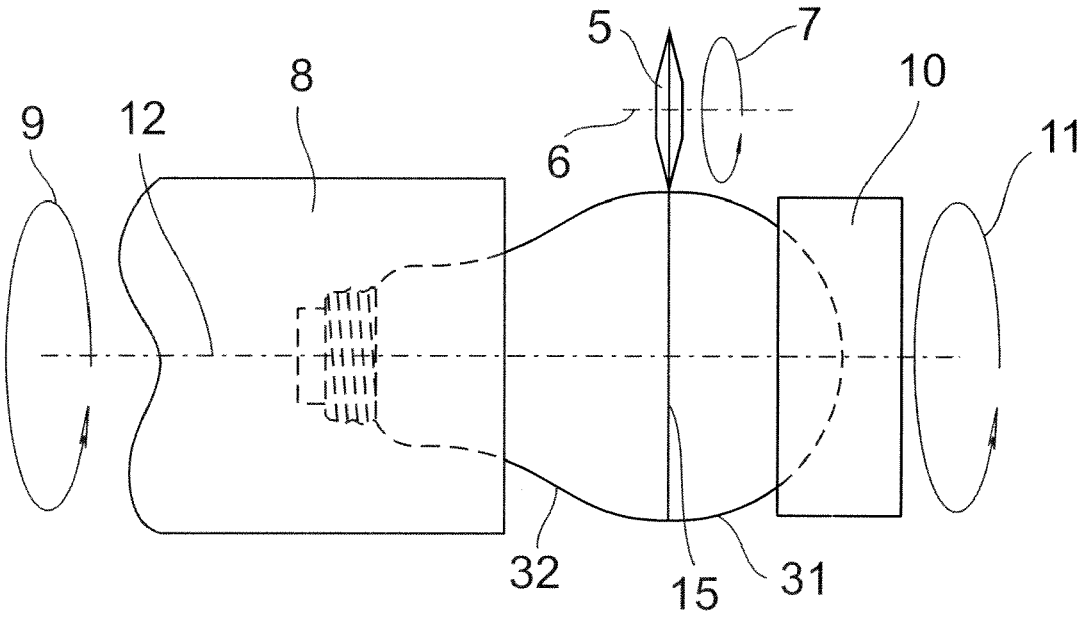
FIG. 4 is a schematic diagram of the manufacturing step of cutting the lamp envelope into two parts.

In the manufacturing process of the electric lamp, we start from an outer envelope having a principal axis and comprising an end portion with a neck portion being terminated by an open end for receiving a base shell as will be described later in detail. In a consecutive step, as depicted in FIG. 4, the outer envelope is received in and held between a first fixing element 10 and a second fixing element 8, which are rotated in a synchronous manner in the same direction as indicated by arrows 11 and 9 respectively. Dashed lines outline the parts of the envelope covered by the fixing elements 10 and 8. During this manufacturing step, the outer envelope is cut in two parts with a cutting dye 5. This may be accomplished by rotating the envelope around its principal axis 12 while bringing the cutting dye 5 above the middle region of the substantially spherical portion of the envelope into a cutting position. The cutting dye can preferably be also rotated around an axis of rotation 6. As it can be clearly seen in this figure, the direction of rotation of the envelope and the cutting dye is the same as indicated by arrows 9, 11, and 7, respectively, which results in an increased cutting speed in the contact point between the envelope and the cutting dye. The separation line 15 created in this way has a circumferential or preferably circular form in a plane substantially perpendicular to the principal axis 12 of the envelope. By cutting the envelope in the way described above, the envelope will be split into a first part 3 and a second part 32. The position of the separation line is selected in the region of the largest diameter of the substantially spherical portion of the outer envelope in order to provide better access to the parts inside the envelope and to enable the use of larger sized light source or discharge tube arrangements.

Figure 5:
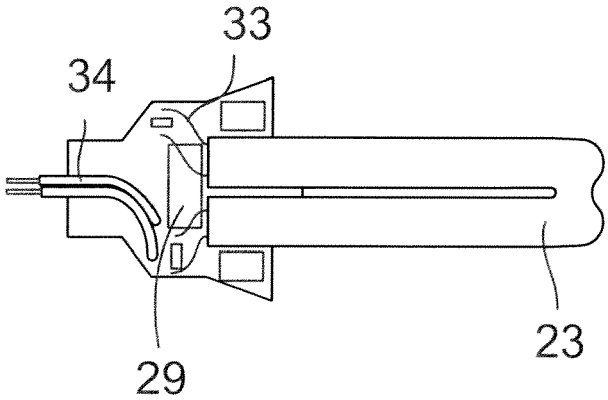
FIG. 5 is a front view of an inner assembly including a discharge tube with straight tube members and a ballast circuit.
Figure 6:
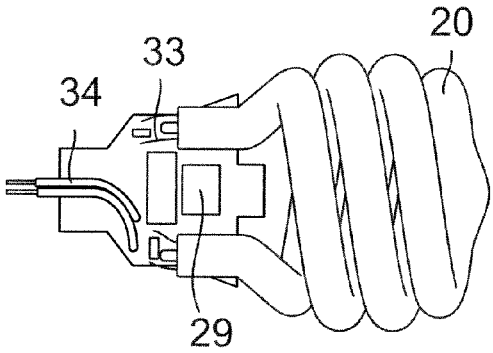
FIG. 6 is a front view of an inner assembly including a discharge tube of helical tube configuration and a ballast circuit.
Figure 7:
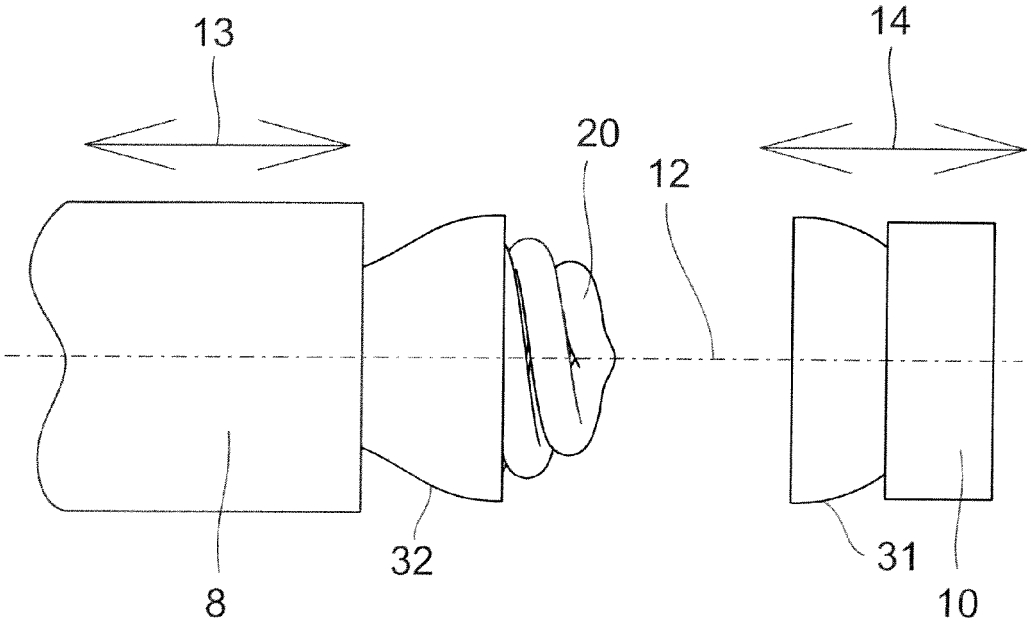
FIG. 7 is a schematic diagram of the manufacturing step of inserting the inner assembly into the neck-side part of the envelope.

As a preparatory step, a light source and a control gear circuit have to be connected to each other in order to provide an inner assembly including a light source and a control gear circuit for placing it into the outer envelope, as shown in FIGS. 5 and 6. After the first part has been removed from the second part of the envelope as indicated by arrows 13 and 14 in FIG. 7, the inside volume will be accessible for the inner assembly of the lamp. In the manufacturing step shown in FIG. 7, the inner assembly including the light source and the control gear circuit is inserted into the second part 32 of the outer envelope. While inserting the light source and the control gear circuit into the second part 32 of the outer envelope, the electric connecting wires are led through an opening in the neck portion. In order to provide electrical insulation between the two lead-out wires, at least one of the wires has to be provided with an insulating layer. The base side end of the lead-out wire provided with an insulating layer has to be free in order to enable electrical contact with one of the contact terminals of the base. In the shown example the light source is a discharge tube arrangement 20 and the control gear circuit is a ballast circuit.

Figure 8:
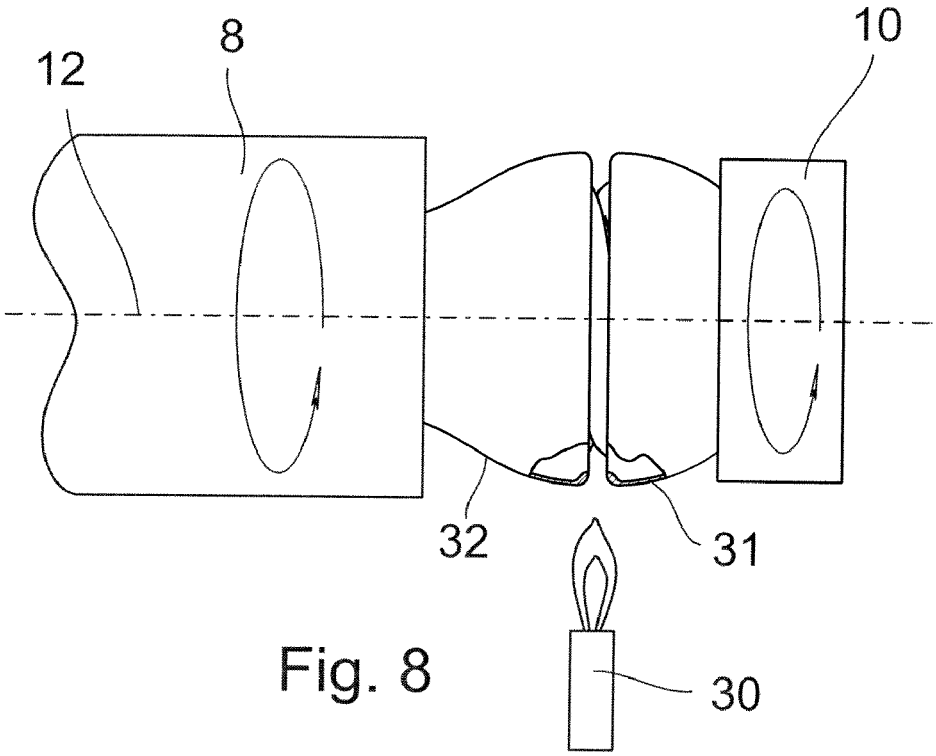
FIG. 8 is a schematic diagram of the manufacturing step of bringing the two parts of the envelope into contact position while applying heat to a seal region.
Figure 9:
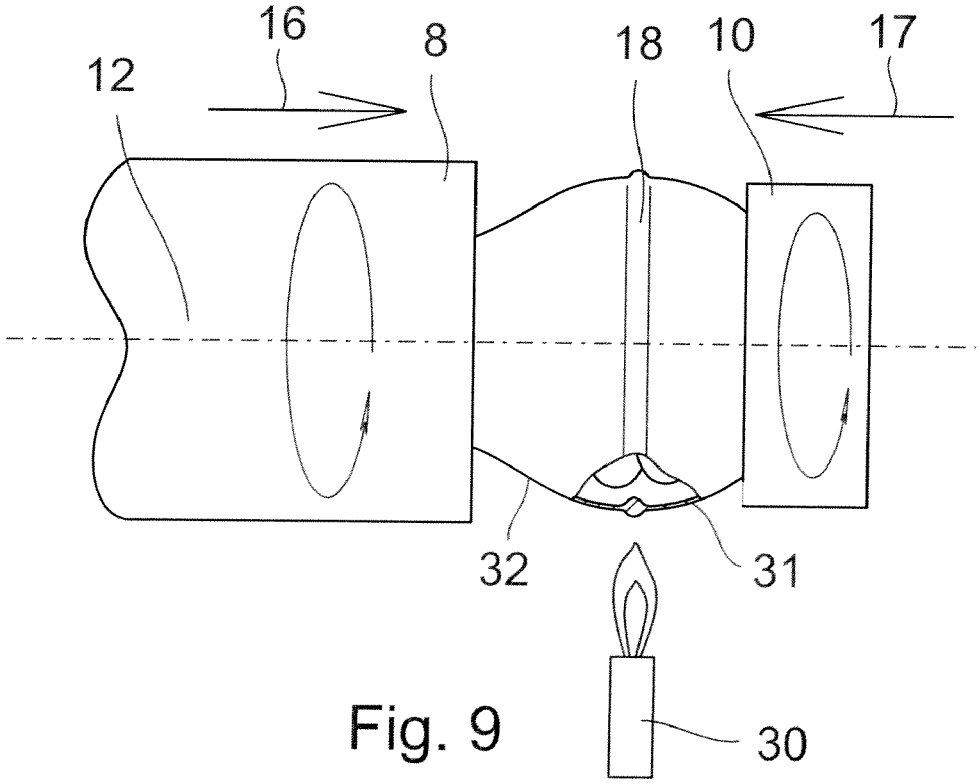
FIG. 9 is a schematic diagram of the manufacturing step of maintaining heating the seal region and compressing the two parts in axial direction.
Figure 10:
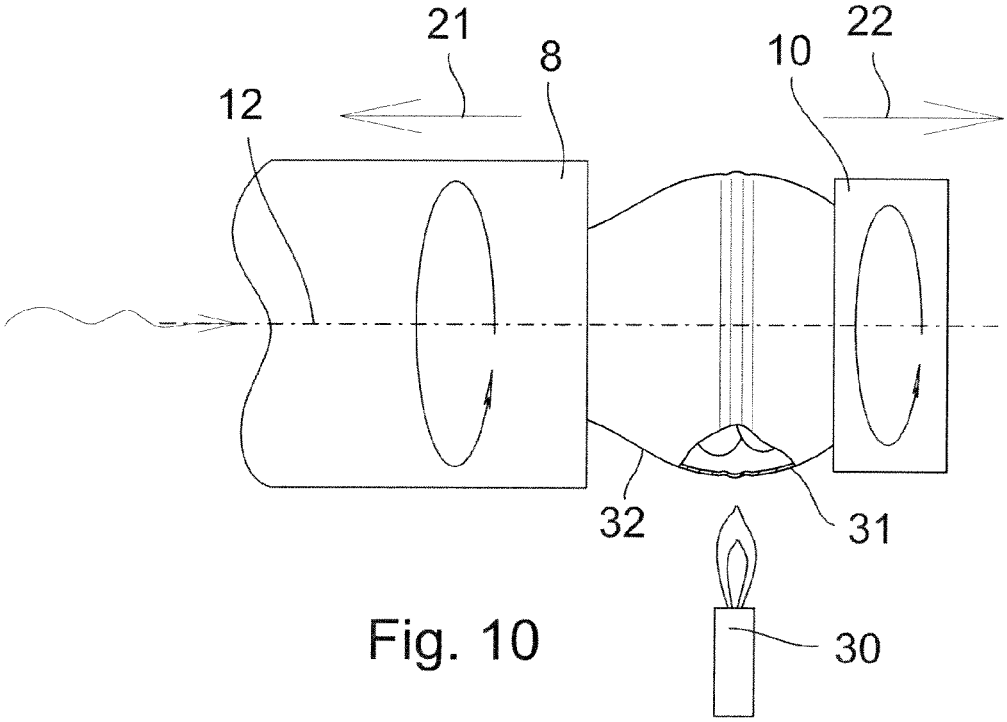
FIG. 10 is a schematic diagram of the manufacturing step of pulling the two parts of the envelope in axial direction.

In the next manufacturing step (see FIG. 8), the first part 31 of the outer envelope is brought in proximity of the second part 32. In order to accomplish a solid mechanical connection or seal between the first part 31 and the second part 32 of the outer envelope, the two parts may be welded together using a heater 30, which may be a gas heater. When heating the edge portion of the two parts 31 and 32 of the outer envelope along the cutting line as shown in FIG. 4, above the softening point of the glass material, the glass wall thickness of the envelope will increase and the diametrical dimension of the envelope will decrease or shrink in the edge region as is can be seen in FIG. 8.

Having melted the edge region of the two parts of the envelope along the separation line, the two parts are brought in a position of contacting each other and than they are further compressed by a first axial distance as indicated by arrows 16 and 17 while maintaining the heating. The first axial distance during the compression of the edge regions of the first part 31 and second part 32 of the envelope may be in the range of 0.2 to 1.5 millimeters, or more preferably in the range of 0.2 to 0.8 millimeters. At this stage, a ring 18 with an increased wall thickness is provided in the seal region as it can be seen in a 30 partial cross sectional view in the lower part of FIG. 9.

In a next step (FIG. 10), the rejoined two parts of the envelope are pulled apart from each other by a second axial distance as indicated by arrows 21 and 22 in order to reduce the wall thickness and the unevenness in the seal region, wherein the second distance is larger than the first axial distance. The second axial distance during pulling the first part and second part of the envelope apart from each other is about 4 millimeters. In order to further increase the effect of the reduction of the wall thickness and the unevenness, an overpressure may be applied to the interior of the envelope that may be in the range of 0.2 to 0.5 mbar, or more preferably about 0.3 mbar. This overpressure will prevent the soft glass material from intruding into the inside of the envelope and it will help to maintain the original shape of the spherical part of the envelope as well.

Figure 11:
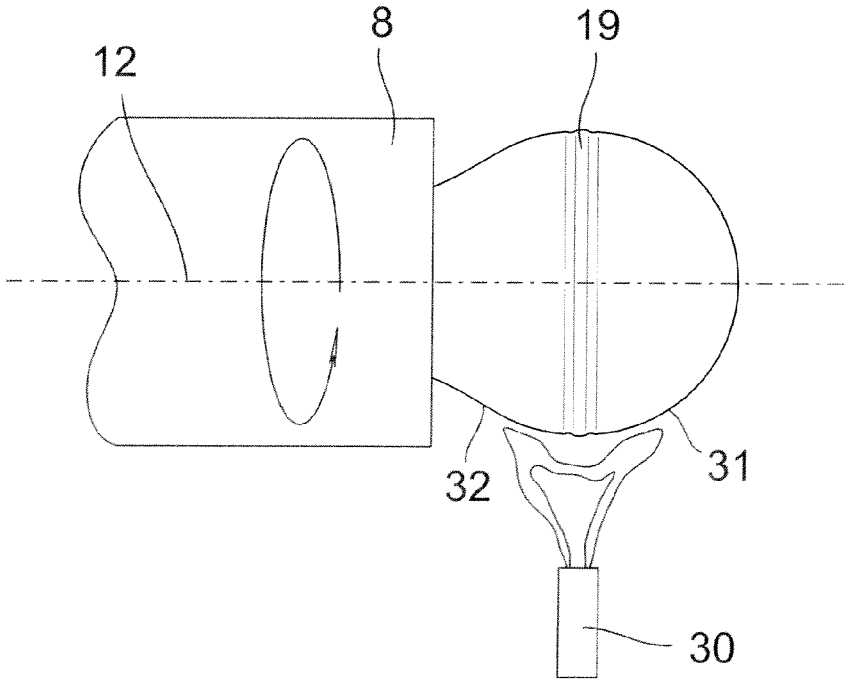
FIG. 11 is a schematic diagram of the manufacturing step of annealing a glass material in the seal region.

Having completed the step of pulling the two parts 31, 32 of the envelope apart, the first part 31 of the envelope will be released from the first fixing element 10 (FIG. 11). While continuing the rotation of the envelope received and held by the second fixing element 8, the seal region 19 is annealed by using the gas heater 30 with a lower energy flame or a soft flame. During this annealing step most of the residual stresses are removed from the seal region 19.

Figure 12:
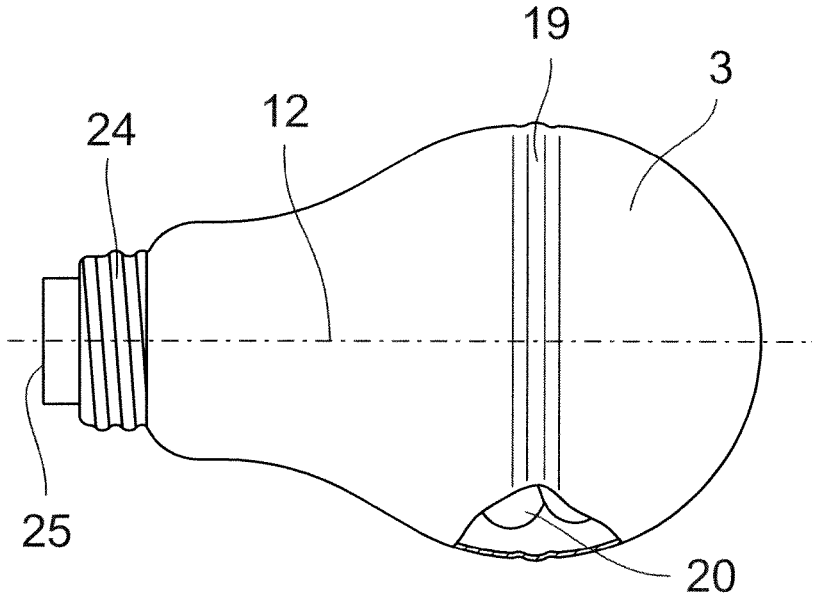
FIG. 12 is a schematic diagram of the sealed lamp envelope enclosing the light source and the electric control gear circuit in the manufacturing of the lamp.

In a consecutive step, the envelope 3 is removed from the second fixing element 8 and all kind of heating is stopped. The envelope is collected and stored before further processing secure from any thermal or mechanical stress that would cause any damage (FIG. 12). As it can be seen the neck portion of the elongated portion of the outer envelope 3 is provided with a threaded outer wall 24 and a tubular opening 25. The threaded outer wall 24, as shown in the drawing, is only needed if a screw type or Edison-type base shell is used. For other types of a base shell, for example if a bayonet type base shell is used this threaded outer surface may be omitted and a different form will be applied to the neck portion.

Figure 13:
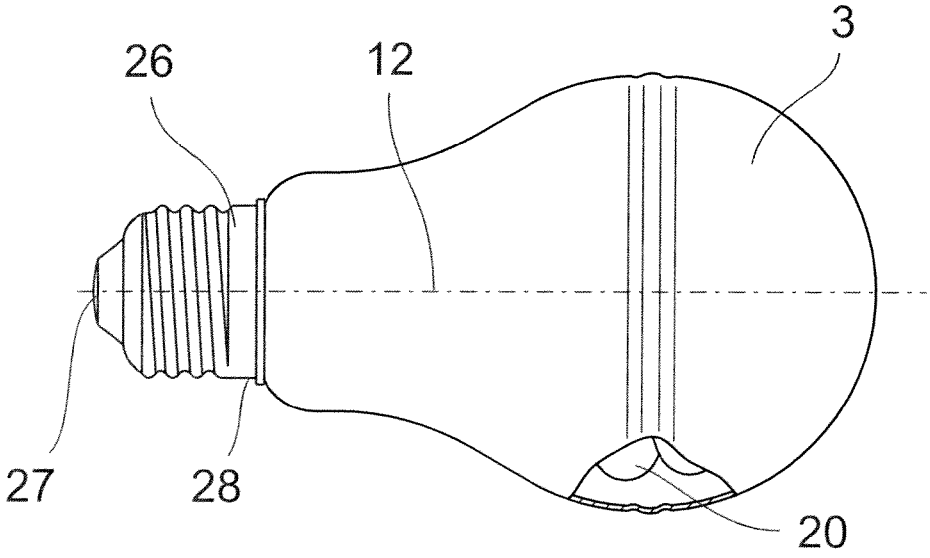
FIG. 13 is a schematic diagram of providing the closed end of the envelope with a base and contact terminals in the manufacturing of the lamp.

Finally, in a last step (FIG. 13), the electric lamp is completed with a base shell 26 for connecting the lamp to a conventional or standard socket of any screw-in or bayonet type. As shown in FIG. 13, the electric lamp, in this example a compact fluorescent lamp is provided with an Edison-type base. The lamp base may be fixed to the base side end of the elongated portion of the outer envelope in any conventional way. The base side end of the elongated portion of the outer envelope may be fixed to the base using an adhesive, cement or a threaded connection. When using a threaded connection with the Edison-type base, it may be screwed onto the threaded end portion of the envelope. The electrical contacts of the current lead wires of the control gear or ballast circuit and the contact terminals 27 and 28 of the base shell 26 are also created in this step.

The invention is not limited to the shown and disclosed embodiments, but other elements, improvements and variations are also within the scope of the invention. For example, it is clear for those skilled in the art that a number of other forms and sizes of the envelope 3 may be applicable for the purposes of the present invention, for example the envelope may have an elliptical or polygonal cross-section and a largest outer diameter that is more than 100 millimeters or less than 50 millimeters. The light source may be selected from any conventional or energy saving light sources, such as CFL-s, LED-s etc. In case of a CFL, the number of discharge tube members within a lamp may also vary according to size or desired power output of the lamp.

The invention claimed is:

1. An electric lamp comprising
an inner assembly including
a light source, and
a control gear circuit for controlling current in the light source and being connected to the electrodes of the light source;
an outer envelope with a predetermined wall thickness, having an end portion and enclosing the light source and at least a part of the control gear circuit;
the end portion of the outer envelope having a neck portion with an open end for receiving a base shell;
the outer envelope defining a principal axis and being comprised of two parts separated along a circumferential line in a plane substantially perpendicular to the principal axis of the envelope, the two parts of the envelope being connectable and sealable to form a uniform outer envelope with a seal region;
the seal region having a wall thickness and being merged in a surface portion of the two parts of the envelope so that the surface unevenness of the seal region is not greater than 0.5 millimeters; and
the maximum difference of the wall thickness of the seal region with respect to the wall thickness of the outer envelope is not greater than 0.3 millimeters.

2. The electric lamp of claim 1, in which the circumferential separation line of the outer envelope is in the region where the envelope has a largest diametrical dimension measured in a plane substantially perpendicular to the principal axis.

3. The electric lamp of claim 1, in which the envelope has a wall thickness of 0.4 millimeters to 1.0 millimeter.

4. The electric lamp of claim 1, in which the seal region has a width of 3-6 millimeters.

5. The electric lamp of claim 1, in which the outer envelope is made of glass.

6. The electric lamp of claim 1, in which the light source has a longitudinal axis and comprises a discharge tube arrangement of substantially straight tube members with a central axis substantially parallel to the longitudinal axis of the fluorescent light source and the neighboring tube members are connected to each other in series to form a continuous arc path, and the tube members are arranged substantially at equal distance from the longitudinal axis of the light source and from each other to provide a substantially homogeneous illumination.

7. The electric lamp of claim 1, in which the light source has a longitudinal axis and comprises a discharge tube arrangement of a single tube with substantially straight end sections and an intermediate portion between the end sections and the end sections being at one end of the tube arrangement and in proximity of each other and the intermediate portion having a coiled configuration wound about the longitudinal axis of the lamp to provide a substantially homogeneous illumination.

8. Method for manufacturing an electric lamp comprising the steps of:
a) providing an outer envelope having a principal axis and comprising an end portion with a neck portion being terminated by an open end for receiving a base shell;
b) separating the envelope by cutting along a circumferential line in a plane substantially perpendicular to the principal axis of the envelope into a first part and a second part, each having an edge region;
c) providing an inner assembly including a light source and a control gear circuit;
d) introducing the inner assembly into the second part of the envelope;
e) bringing the separated first part and second part of the envelope along the separation line in proximity of each other;
f) heating the edge region of the first part and second part of the envelope to the softening point;
g) connecting and sealing the first and second part of the envelope along the separation line, the connecting and sealing step comprising further steps of
h) bringing the two parts into a contacting position and compressing the two parts further by a first axial distance while maintaining the heating;
i) pulling the two parts apart from each other by a second axial distance in order to merge the seal region in a surface portion of the two parts, wherein the second axial distance is larger than the first axial distance.

9. The method of claim 8, in which during step i) an overpressure is applied to the interior of the envelope.

10. The method of claim 9, in which the overpressure applied to the interior of the envelope is about 0.2 to 0.5 mbar.

11. The method of claim 9, in which the overpressure applied to the interior of the envelope is about 0.3 mbar.

12. The method of claim 8, in which the first axial distance during the compression of the first part and second part of the envelope is the range of 0.2 to 1.5 millimeters.

13. The method of claim 8, in which the first axial distance during the compression of the first part and second part of the envelope is the range of 0.2 to 0.8 millimeters.

14. The method of claim 8, in which the second axial distance during pulling the first part and second part of the envelope apart from each other is about 4 millimeters.

* * * * *